United States Patent [19]

Jenkins

[11] Patent Number: 4,736,947

[45] Date of Patent: Apr. 12, 1988

[54] BLOCKING SLED

[76] Inventor: Eugene C. Jenkins, P.O. Box 448, Canyon, Tex. 79015

[21] Appl. No.: 881,622

[22] Filed: Jul. 3, 1986

[51] Int. Cl.[4] ..... A63B 67/00

[52] U.S. Cl. ..... 273/55 R; 273/DIG. 26

[58] Field of Search ..... 273/55 R, 55 B, DIG. 26

[56] References Cited

U.S. PATENT DOCUMENTS

| | | | |
|---|---|---|---|
| 2,466,954 | 4/1949 | King | 273/55 R |
| 2,521,649 | 9/1950 | Paupa | 273/55 R |
| 3,114,549 | 12/1963 | Hooker | 273/55 R |
| 3,425,692 | 2/1969 | Leach | 273/55 R |
| 3,866,914 | 2/1975 | Jackson et al. | 273/55 R |
| 3,889,949 | 6/1975 | Gardner | 273/55 R |
| 3,999,755 | 12/1976 | Shealy, Jr. | 273/55 R |
| 4,477,076 | 10/1984 | Monaco | 273/55 R |

*Primary Examiner*—Richard C. Pinkham
*Assistant Examiner*—T. Brown
*Attorney, Agent, or Firm*—Wendell Coffee

[57] ABSTRACT

A blocking sled for use in training football players includes runners which the player straddles to train him to keep his feet apart. The coach rides on a platform behind the athlete watching the athlete move forward and push the dummy at the front while keeping his body low and below chute bars above him. Outriggers outside the runners give the sled stability.

5 Claims, 2 Drawing Sheets

BLOCKING SLED

RIGHTS TO INVENTIONS UNDER FEDERAL RESEARCH

There was no federally sponsored research and development concerning this invention.

BACKGROUND OF THE INVENTION (1) Field of the Invention

This invention relates to exercise devices and more particularly to a football blocking sled. This type of equipment is used by high school football teams and a high school football coach would be one having ordinary skill in the art.

(2) Description of the Related Art

Many blocking sleds were on the market before my invention. For example, before my invention the athlete would face the coach riding on a sled. Some sleds provided that the athlete would straddle runners to train the athlete to keep his feet apart.

Some sleds have a roller thereon so that as the blocking pad is pushed upward the roller lifts the sled making it easier to move.

Also before my invention, a chute was on the market. The chute had structure over the athlete to train him to keep his body low. The chute was not a sled and did not include a blocking dummy.

Before this application was filed, a search was made in the U.S. Patent and Trademark Office. That search developed the following patents: Malagio, U.S. Pat. No. 2,620,188; Thompson, U.S. Pat. No. 3,398,953; Drakulich, U.S. Pat. No. 3,443,810; Hornak et al, U.S. Pat. No. 3,580,574; Rogers, U.S. Pat. No. 3,827,690; Visco, U.S. Pat. No. 3,889,948; Rogers, U.S. Pat. No. 4,067,571.

Rogers illustrates a drag structure to train the athlete to keep his feet wide apart.

Visco discloses a football blocking training apparatus which has a vertical post with a dummy mounted on it by passing the post through a sleeve on the dummy.

Applicant believes that the remaining patents of the search would be of interest to the Examiner. These patents are considered pertinent because the applicant believes the Examiner would consider anything revealed by the search to be relevant and pertinent to the examination of this application.

SUMMARY OF THE INVENTION (1) Contribution to the Progress of the Useful Arts

My contribution to the progress of the athletic exercise and training equipment is to provide a unitary integrated sled which trains the athlete, when blocking, to keep his legs wide apart, his head and body down, and to push upward upon his opponent.

Also I have provided a blocking sled where the coach rides on the sled behind the athlete in order to obtain a better view of the body, feet and legs of the athlete while practicing blocking.

The runners which are common to many sleds are used in my sled to also teach the athlete to keep his legs wide apart. Outriggers provide additional stability of the sled. The chute bars above the head of the athlete are used to provide a portion of the strength of the structure as well as to train the athlete to keep his head in the proper position. I provide a platform at the rear of the sled for the coach to ride so as to be in a better position to observe the entire body and particularly the feet and legs of the athlete.

With this arrangement of the sled, the weight of the sled is concentrated to the rear of the athlete. Therefore, as the athlete blocks upward upon the dummy he tends to lift the front of the sled, making the sled easier to move along the ground. This is a natural result of lifting the front of the sled and it is not necessary to use rollers and the associated mechanism of the rollers. It will be noted that on the prior art devices that the runners and weight of the sled are forward of the dummy and therefore lifting upward on the dummy tends to cause the sled to dig in and be more difficult to push were it not for the mechanisms causing the roller to be pushed downward.

(2) Objects of this Invention

An object of this invention is to train football athletes in the proper techniques related to blocking.

Further objects are to achieve the above with a device that is sturdy, compact, durable, lightweight, simple, safe, efficient, versatile, ecologically compatible, energy conserving, and reliable, yet inexpensive and easy to manufacture, and maintain.

Other objects are to achieve the above with a method that is versatile, ecologically compatible, energy conserving, rapid, efficient, and inexpensive, and does not require skilled people to operate, and maintain.

The specific nature of the invention, as well as other objects, uses, and advantages thereof, will clearly appear from the following description and from the accompanying drawing, the different views of which are not scale drawings.

Figure 1:
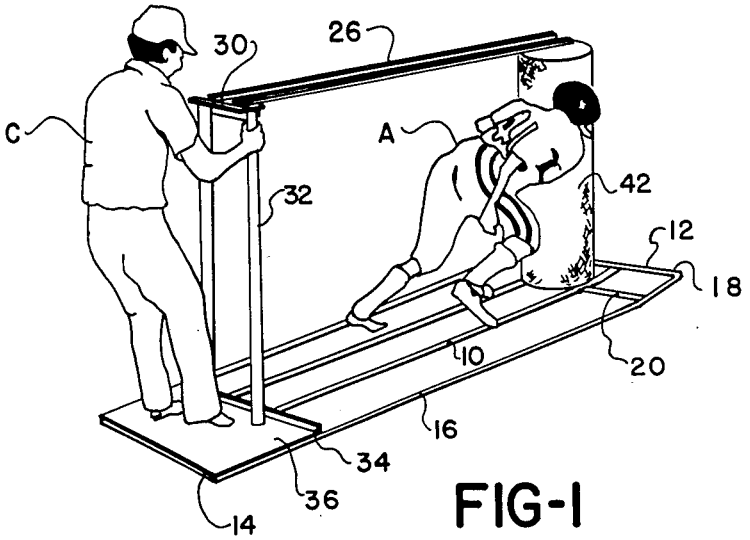
FIG. 1 is a perspective view of a blocking sled according to my invention in use.
Figure 2:
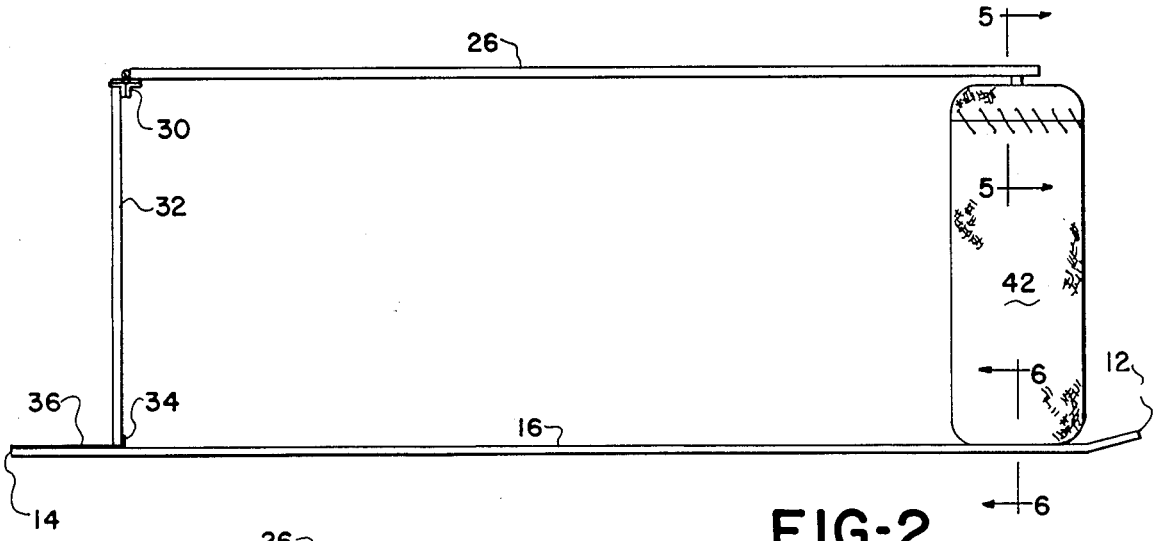
FIG. 2 is a side elevational view of the sled.
Figure 7:
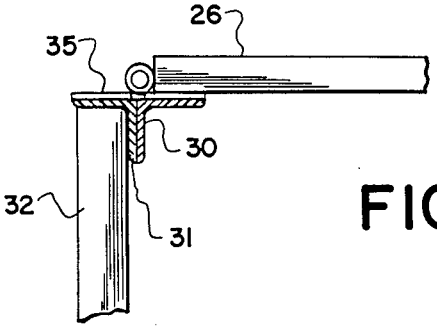
FIG. 7 is a detail view of the connection of the chute bars to the hand stanchions.
Figure 3:
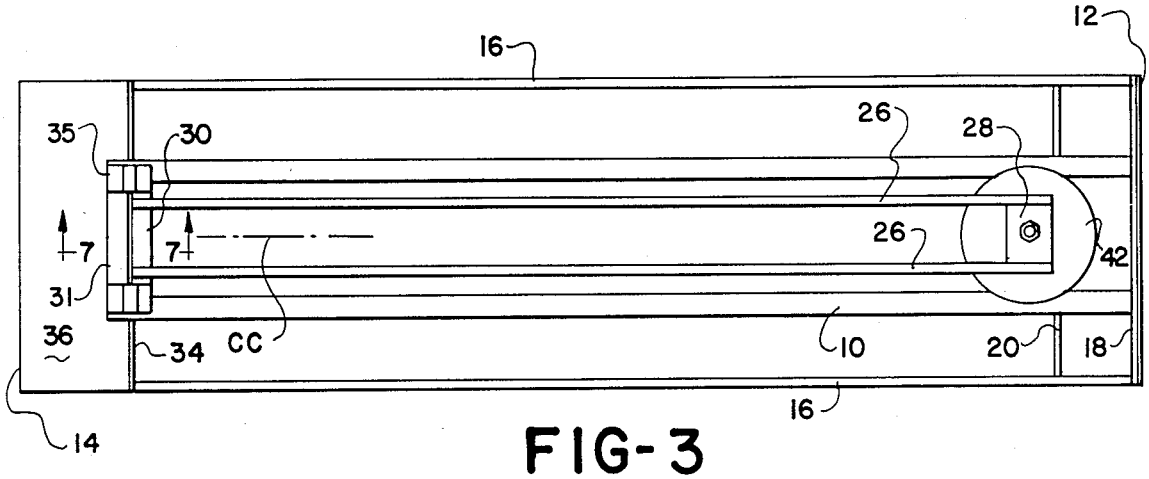
FIG. 3 is a top plan view of the sled.
Figure 6:
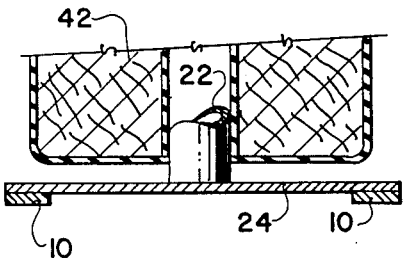
FIG. 6 is a sectional detail of the bottom of the dummy taken on line 6—6 of FIG. 4.
Figure 5:
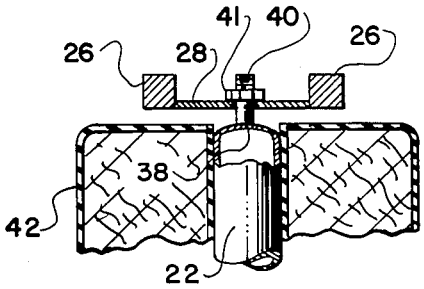
FIG. 5 is a section detail of the top of the dummy taken on line 5—5 of FIG. 4.
Figure 4:
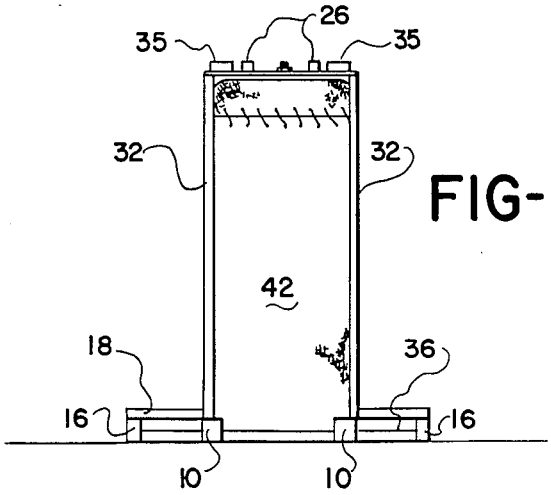
FIG. 4 is a rear elevational view of the sled.

As an aid to correlating the terms describing this invention to the exemplary drawing the following Catalog of Elements is provided:

| | | | |
|---|---|---|---|
| 10 | runners | 32 | hand stanchion |
| 12 | front | 34 | angle iron |
| 14 | back | 35 | hinges |
| 16 | outrigger | 36 | platform |
| 18 | nose bar | 38 | cap |
| 20 | cross bar | 40 | stud |
| 22 | stanchion | 41 | nut |
| 24 | brace | 42 | dummy |
| 26 | chute bars | "A" | athlete |
| 28 | cross piece | "C" | coach |
| 30 | cross piece | "CC" | centerline |
| 31 | top angle iron | | |

DESCRIPTION OF THE PREFERRED EMBODIMENT

Referring to the drawings there may be seen a blocking sled according to my invention. The sled includes a pair of runners 10 which run from front 12 to back 14. The runners are evenly spaced on either of the centerline "CC" of the sled. The runners are parallel to the centerline. The runners are spaced apart the proper distance for training the athlete to keep his feet apart. Outriggers 16 are on either side of the runners 10. The outriggers are spaced from the runners a distance to permit the athlete to have foot space between the runner and the outrigger but not to interfere with his endeavors.

Nose bar 18 extends across the front of the sled and is connected by welding to the runners 10 and the outrigger 16.

Cross bar 20 is located behind the nose bar and is connected to the runners and outriggers by welding.

The runners and the outriggers are angled up or turned up just forward of the cross bar 20 so that the runners and outriggers are above the ground at the nose bar 18. It may be seen with this arrangement that the sled will easily slide forward.

Vertical stanchion 22 is attached as by welding to brace 24 which extends from across the runners 10 immediately behind the cross bar 20. The top of the stanchion 22 is attached as later described to the front of chute bars 26 by cross piece 28.

The rear of the chute bars 26 are connected to an angle iron forming cross piece 30. Top angle iron 31 connects hand stanchions 32. The hand stanchions 32 are vertical and connected at their lower end to angle iron 34 which is connected near the rear of runners 10. The cross piece 30 is hinged to the top angle iron 31 by hinges 35.

Platform 36 in the form of expanded metal is attached as by welding from the angle iron 34 and extends to the back 14 of the sled. The platform 36 is of proper size for a coach "C" to stand thereon.

The dummy stanchion 22 is a tubular member, preferably a pipe, which has cap 38 on top. Stud 40 is welded to the cap and extends through a hole in the cross piece 28. The parts are secured together by nut 41 on the stud. The chute bars 26 may be hinged up about the hinges 35 when the nut 41 is removed.

Dummy 42 is cylindrical padded dummy with an axial bore therethrough. Therefore, it may be readily telescoped over the dummy stanchion 22 with the chute bars 26 hinged up. Thereafter the bars 26 are lowered and bolted to the dummy stanchion.

I have found that having the distance between from one outrigger 16 to the other to be about three times the distance between one runner amd the other works well.

Also I have found that to have the height of the chute bars to be about the same height as the distance between the outriggers 16 works well. I.e., the distance from the runners 10 to the chute bar 26 is about three times the distance between the runners. Also I have found that having the distance between the dummy stanchion and the hand stanchions to be about twice the distance between the outriggers works well. I.e., this distance is about five or six times the distance between the runners. I found the distance between the chute bars to be about half the distance between the runners works well. A sled according to this will have a length of about 126 inches and a height of about 48 inches and will have a total weight of about 210 pounds.

In use the coach "C" will stand on the platform 36 holding with his hands onto the hand stanchion 32 and be in position to observe the athlete "A" to start from a position with his feet near the hand stanchion and observe the feet, legs, head, and back of the athlete as he advances to the dummy 42 and pushes forward and upwardly against the dummy.

The embodiment shown and described above is only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A blocking sled comprising:

a. ground engaging runners parallel to a longitudinal centerline, b. said runners turned up at a front end so the sled will easily slide forward, c. chute bars having a front and back parallel to and above the runners, d. a substantially vertical dummy stanchion connecting the front of the chute bars to the runners near the front end thereof, e. a padded blocking dummy attached to the dummy stanchion, f. a hand stanchion connecting the back of the chute bars to the runners near the back thereof, and g. a coach's platform on the runners behind the hand stanchion, h. so that a coach may stand on the coach's platform and observe an athlete straddling the runners beneath the chute bars pushing the dummy with his shoulders.

2. The invention as defined in claim 1 further comprising:

i. said blocking dummy being tubular and telescoped around the dummy stanchion.

3. The invention as defined in claim 1 further comprising:

i. outriggers connected to the runners at the front and rear ends and parallel to and spaced from said runners so that the blocking sled has more stability than with the runners alone.

4. The invention as defined in claim 3 further comprising:

j. said outriggers extending the full length of the sled, k. said coach's platform being attached to the outriggers as well as the runners, and l. said coach's platform being made of expanded metal.

5. The invention as defined in claim 4 further comprising:

m. said blocking dummy being tubular and telescoped around the dummy stanchion.

* * * * *